US007097490B2

(12) United States Patent
Eaton et al.

(10) Patent No.: US 7,097,490 B2
(45) Date of Patent: Aug. 29, 2006

(54) ELECTRICAL CONNECTOR

(75) Inventors: John Eaton, Brighton (GB); Michael James Cruttenden, Hove (GB)

(73) Assignee: EDO MBM Technology Limited, (GB)

( * ) Notice: Subject to any disclaimer, the term of this patent is extended or adjusted under 35 U.S.C. 154(b) by 0 days.

(21) Appl. No.: 10/733,458

(22) Filed: Dec. 11, 2003

(65) Prior Publication Data

US 2004/0175977 A1 Sep. 9, 2004

(30) Foreign Application Priority Data

Dec. 17, 2002 (GB) ..... 0229347.0

(51) Int. Cl.
*H01R 13/627* (2006.01)

(52) U.S. Cl. ..... 439/350

(58) Field of Classification Search ..... 439/254, 439/349–353, 357, 369, 256, 257, 155, 692, 439/695, 697, 152, 153, 258, 355, 253
See application file for complete search history.

(56) References Cited

U.S. PATENT DOCUMENTS

| | | | | |
|---|---|---|---|---|
| 2,856,690 A | | 9/1958 | Madison | |
| 3,328,743 A | * | 6/1967 | Acord | 439/258 |
| 3,430,184 A | * | 2/1969 | Acord | 439/255 |
| 3,452,316 A | * | 6/1969 | Mocek et al. | 439/255 |
| 3,496,519 A | * | 2/1970 | Vetter | 439/258 |
| 4,265,503 A | | 5/1981 | Baur | |
| 4,279,458 A | * | 7/1981 | Knapp | 439/255 |
| 4,390,222 A | | 6/1983 | Carter | |
| 4,447,103 A | * | 5/1984 | Werth et al. | 439/271 |
| 4,533,194 A | * | 8/1985 | Boichut et al. | 439/347 |
| 4,684,192 A | | 8/1987 | Long et al. | |
| 4,695,109 A | * | 9/1987 | Ratchford | 439/155 |
| 4,702,537 A | | 10/1987 | Mattingly et al. | |
| 5,538,439 A | | 7/1996 | Fell et al. | |

FOREIGN PATENT DOCUMENTS

EP 0 334 610 A1 9/1989

OTHER PUBLICATIONS

Press release entitled "14th Jun. 2003—MBM resolves UK 'smart' weapon separation into RAF service of a 'jam-free', Field Replaceable Connector Shell," published on EDO MBM Technology Limited's website (Jun. 14, 2003).

* cited by examiner

*Primary Examiner*—Ross Gushi
(74) *Attorney, Agent, or Firm*—Dean W. Russell; Kristin M. Crall; Kilpatrick Stockton LLP

(57) ABSTRACT

An electrical connector disposed between a store and an aircraft or dispenser comprises a first store-side part mechanically connected to the store and a second aircraft-side complementary part connected to an electrical cable attached to the aircraft or dispenser at a forward end, the aircraft-side part comprising a core containing electrical contacts and an outer shell engagable with the store-side part to securely retain the aircraft-side part in mating engagement with the store-side part while the store is being carried by the aircraft, the outer shell being adapted to be pulled off the store-side part as the store is separated from the aircraft, the outer shell being formed as a separate component or assembly, removably attached to the aircraft-side part core.

6 Claims, 2 Drawing Sheets

50
10
34
36
12
56
50
24
48
42
24
34
16
18
34
28
50
10

ELECTRICAL CONNECTOR

CROSS REFERENCE TO RELATED APPLICATION

This application claims priority to Great Britain Application No. 0229347.0 filed on Dec. 17, 2002, the entire contents of which are incorporated herein by reference.

BACKGROUND OF THE INVENTION

This invention concerns electrical connectors for stores to be released or ejected from an aircraft. The electrical connector must be positively and safely disconnected to avoid damage to the electrical circuit and its anchoring points on the store and aircraft or dispensing system, as the store separates from the aircraft, often at considerable relative speed. This function is normally achieved by firmly securing a first half of the connector to the store and fitting a second half of the connector at the end of a flexible cable extending from the aircraft or dispensing system. A lanyard is secured between a fixed strong point on the aircraft or dispensing system and the connector second half, so that as the store separates from the aircraft, the lanyard is tensioned and releases a spring-loaded coupling sleeve on the connector, thereby allowing the two halves to separate. The length of the lanyard is shorter than the cable, which is therefore not subjected to excessive strain as the connector halves are pulled apart.

Whilst the store remains attached to the aircraft, the connector halves must be maintained together securely to resist premature separation by vibration and aerodynamic and inertial loads. In its rest position, the coupling sleeve keeps locking balls or dogs engaged in a co-operating groove in a retaining ring which is screwed onto the connector first half, to make up the electrical connection. The known connector therefore has a screw-on, pull-off action. Under certain conditions, for example very high separation speeds, this connector can fail to separate correctly. The aircraft side (second) connector half, including the electrical contacts, conductors and insulator blocks within it, can be damaged, requiring replacement before the store can be replenished. This is a lengthy operation, needing specialist tools and facilities.

SUMMARY OF THE INVENTION

The present invention aims to mitigate or eliminate these problems and provides an electrical connector disposed in use between a store and an aircraft or dispenser, a first half of the connector being mechanically connected to one of the store or the aircraft/dispenser and a second, complementary half of the connector being connected to an electrical cable attached to the other of the store or the aircraft/dispenser, the connector second half comprising a core containing electrical contacts and an outer shell snap-engageable with the first connector half to securely retain the connector second half in mating engagement with the connector first half while the store is being carried by the aircraft/dispenser, the outer shell being pulled off the connector first half as the store is separated from the aircraft/dispenser, the outer shell being formed as a separate component or assembly, removably attached to the connector second half core. The snap-engageable connector of the invention performs well even at high separation speeds. Furthermore, even if it fails to disconnect cleanly, any resulting damage to the second half is likely to be confined to the outer shell. This is readily replaceable in the field, without disturbing the cable or its electrical connections to the core of the second connector half.

Preferably the snap-engagement is provided by a resilient finger extending axially between the first and second connector halves, the finger being attached to one of the connector halves and engageable with a detent provided on the other connector half. The finger may be attached to a ring mounted on a sleeve comprising the outer shell.

The outer shell may furthermore comprise an attachment ring rotatable about the second connector half and to which ends of a lanyard are anchored.

The outer shell may be held on the connector second half core by a threaded clamping ring.

It may also be provided with EMC shielding.

The detent may be a circumferential rib formed on a collar threadingly or otherwise connected to the connector first half.

Further preferred features and advantages of the invention may be understood from an illustrative embodiment, described below with reference to the accompanying drawings.

DETAILED DESCRIPTION OF THE PREFERRED EMBODIMENTS

Figure 1:
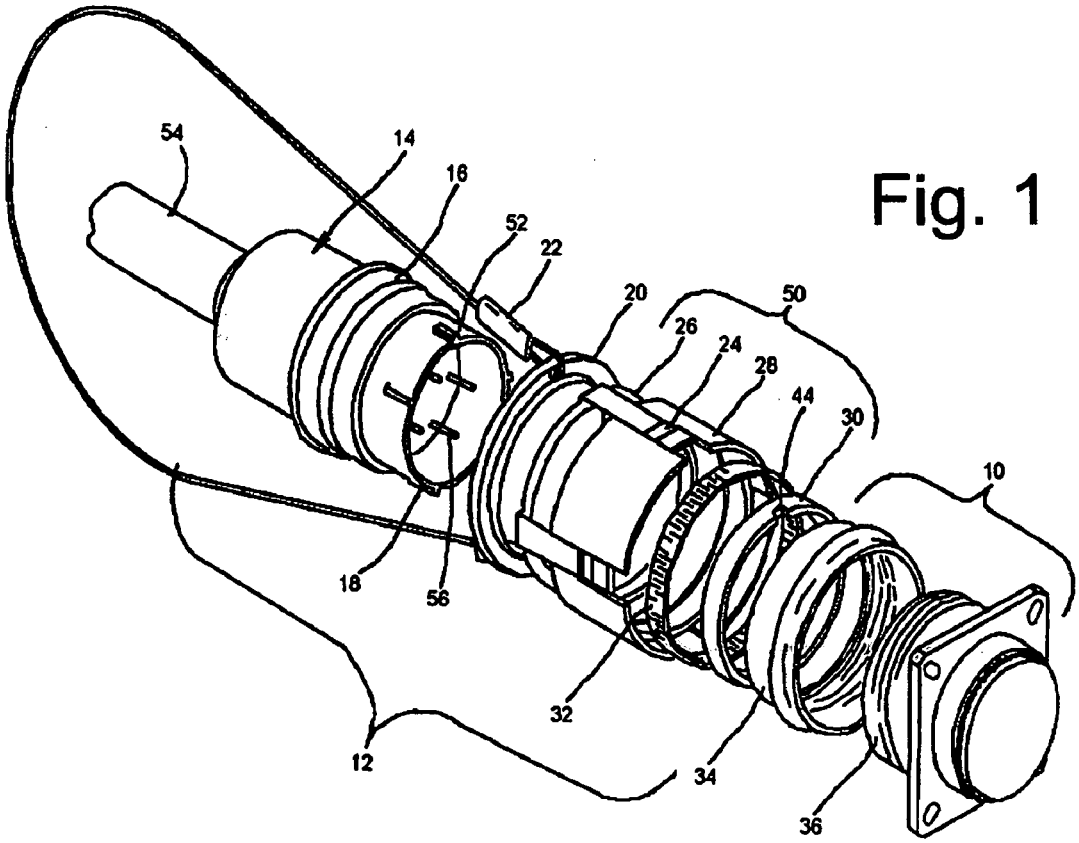
FIG. 1 is an exploded perspective view of a connector embodying the invention.

Referring to the Figures, which show an example of one embodiment of the invention, FIG. 1 shows a connector with a first store-side part 10 and a second aircraft-side part 12. (Store-side part 10 may be referred to throughout this document as first part, first half, or first connector half. Aircraft-side part 12 may be referred to throughout this document as second part, second half, or second connector half.) The second aircraft-side part comprises a core 14 containing the required electrical conductors and contacts 56 at a forward end 52 near an electric cable 54. The electrical contacts 56 are surrounded by a barrel 16 having keys 18 for rotational alignment of the first and second parts 10, 12 and proper registration of the electrical contacts 56 in them. The aircraft-side part 12 further comprises an attachment ring 20 to which ends of a lanyard 22 are anchored, and an outer shell 50 assembled from a molded sleeve 28, an internally threaded clamping ring 30 and resilient metallic (e.g., spring steel) fingers 24 integrally formed with a mounting ring 26.

Figure 2:
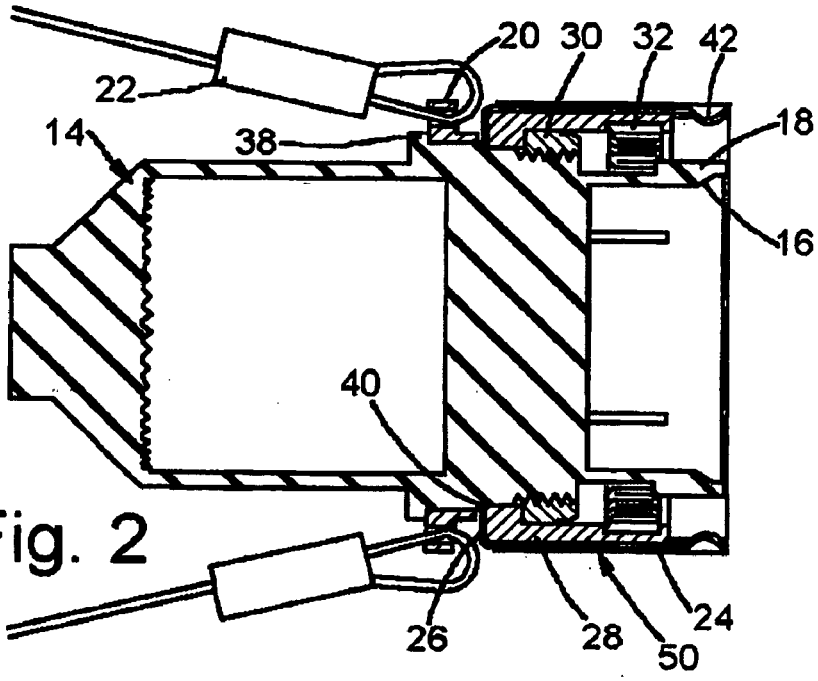
FIG. 2 is a cross-sectional view of the second half of the connector of FIG. 1.

To assemble the aircraft-side part 12, as shown in FIG. 2, the attachment ring 20 is slid over the barrel up to a shoulder 38 on the core 14. The attachment ring 20 is shown wit a lanyard 22 fitted. However, alternate embodiments could include an alternative cable strain relief device or interface. The next component fitted over the barrel 16 is mounting ring 26 and fingers 24, which are pre-assembled on the sleeve 28 together with an electro-magnetic compatibility (EMC) shielding ring 32. This assembly 24, 26, 28 is retained over the barrel by the clamping ring 30, which is screwed onto eternal threads on the core 14. Tightening the ring 30 clamps the sleeve 28 and mounting ring 26 against a further Shoulder 40 formed on the core 14. The attachment ring 20 is thereby trapped for free rotation on the core 14 between the shoulder 38 and the mounting ring 26.

Figures 3, 4, 5:
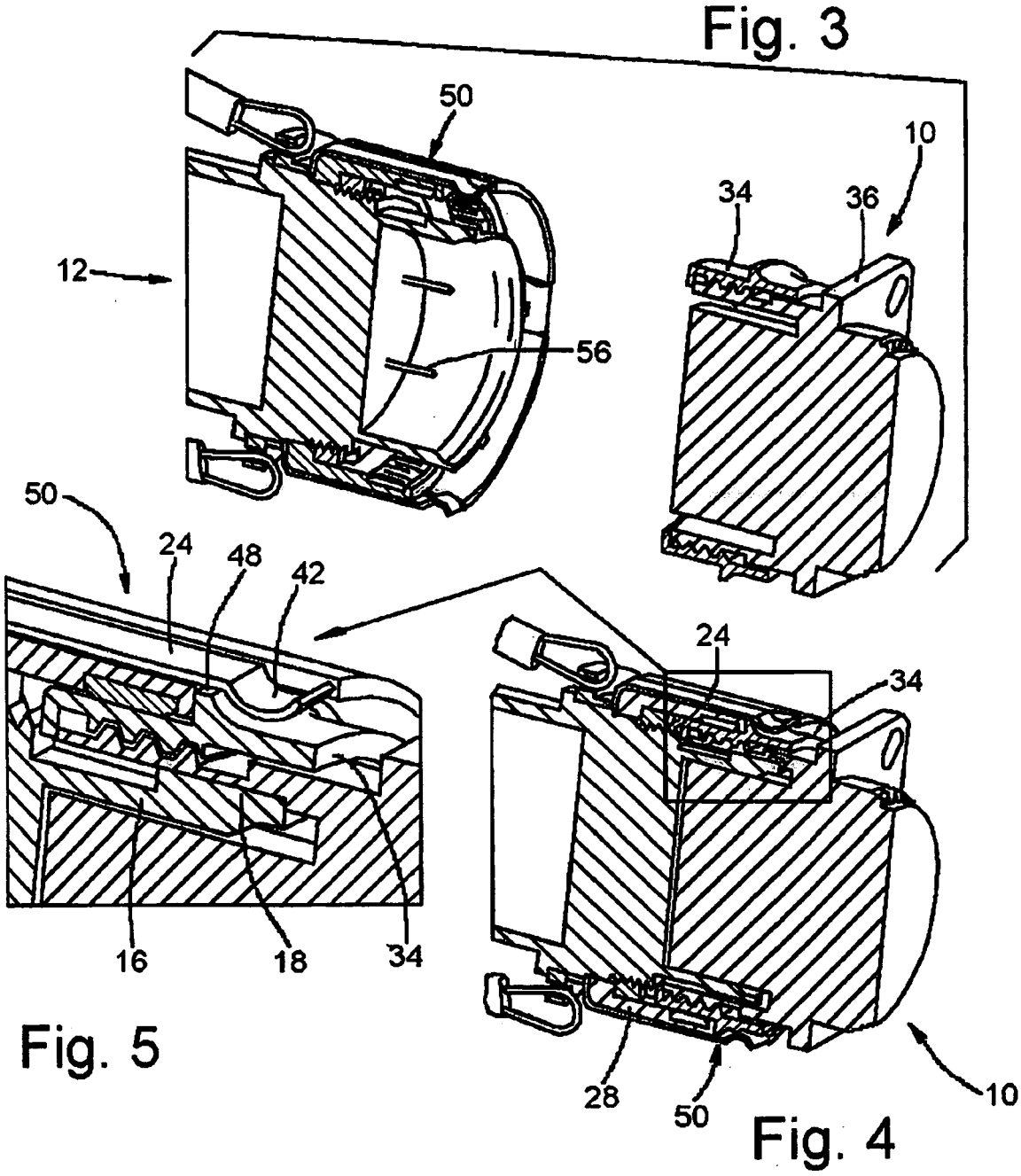
FIG. 3 shows the first half of the connector of FIG. 1 and co-operating parts of the second half.
FIG. 4 shows the two connector halves mated together.
FIG. 5 is an enlarged view of part of FIG. 4.

The fingers are located in axial slots formed in the exterior of the sleeve 28. The distal ends of the fingers are formed with inwardly extending curved tips 42, received in through-going slots formed in the free end of the sleeve 28. (See FIG. 3). The sleeve 28 is the main mechanical structure which provides support to the spring fingers 24 and the EMC shield 32. The spring fingers provide the means to retain the two mating halves 10, 12 of the connector together using their curved tips 42, as further explained below. Although four fingers 24 are illustrated, there could be two through to eight or more, depending on the size of the connector core components to be mated. The EMC shield 32 is optional, depending on the overall requirements for the connector EMC performance. The type of braid which can be fitted provides a full 360° screening/bonding performance.

The clamping ring 30 has features (e.g. slots 44, FIG. 1) that allow the ring to be hand torqued into place using a suitable tool. This completes the assembly of the aircraft-side connector at the end of the flexible cable. On the standard store connector receptacle 36 forming part of the first connector half, the only item which needs to be added is a detent collar 34 which as shown is screwed onto external threads (see FIG. 3). Alternatively, different standard collar fittings (e.g. bayonet fittings) can be used to suit a given store connector receptacle 36.

Obviously the features of the two connector halves 10, 12 can be swapped to provide the best solution for an individual application.

The connector once assembled is simple to operate as the two halves 10, 12 are mated by first aligning the keys 18 with keyways in the other connector half (where necessary) and then pushing the two halves together. As the contacts in the core 14 and store receptacle 36 engage, the spring fingers 24 open over a shaped rib 48 on the detent collar 34 (see FIG. 5). As the electrical contacts mate fully home so the spring fingers spring back into position having moved over the rib 48. As shown, the rib 48 has a curved profile to match the profile of the finger tips 42. To disengage the connector, the second half 12 can be pulled by the attachment ring 20 which provides a tensile load on the core 14 and therefore provides the force to push apart the spring fingers 42 over the rib 48.

The connector provides for easy and reliable mating and demating of the connector halves under extreme conditions. The connector system allows simple replacement of the mechanical retention mechanism whilst being in the field, without the need to remove electrical contacts.

The invention claimed is:

1. An electrical connector disposed between a store and an aircraft or dispenser and comprising, (a) an aircraft-side part mechanically connected to the aircraft or dispenser, (b) a complementary store-side part mechanically connected to the store, an electrical cable comprising one of the mechanical connections, the aircraft-side part comprising:

i. a core having a forward end containing electrical contacts for engaging corresponding contacts in the store-side part;

ii. an outer shell snap-engageable with the store-side part to securely retain the aircraft-side part in mating engagement with the store-side part while the store is being carried by the aircraft or dispenser, the outer shell adapted to be pulled off the store-side part by separation of the store from the aircraft or dispenser, the outer shell being formed as a separate component or assembly, removably attached to the core and adapted to be removed from the core from the forward end on disassembly; and iii. a threaded clamping ring threadingly engaged with the core and by which the outer shell is clamped to the core.

2. An electrical connector as defined in claim 1 in which the outer shell comprises an attachment ring rotatable about the aircraft-side part and to which ends of a lanyard are anchored.

3. An electrical connector as defined in claim 1 in which the outer shell is provided with electro-niagnetic compatibility shielding.

4. An electrical connector as defined in claim 1 in which the snap-engagement is provided by a resilient finger extending axially between the aircraft-side part and the store-side part, the finger being attached to one of the parts and engageable with a detent provided on the other part.

5. An electrical connector as defined in claim 4 in which the finger is attached to a ring mounted on a sleeve comprising the outer shell.

6. An electrical connector as defined in claim 4 in which the detent is a circumferential rib formed on a collar connected to the store-side part.

* * * * *